United States Patent [19]

Vetter et al.

[11] 4,193,732

[45] Mar. 18, 1980

[54] LOADING AND UNLOADING STATION FOR CONVEYORS WITH SUSPENDED TROLLEY DRIVING SYSTEMS

[75] Inventors: Klaus Vetter, Rastatt, Fed. Rep. of Germany; Hermann Baudendistel, deceased, late of Rastatt, Fed. Rep. of Germany, by Rosemarie Baudendistel, heir

[73] Assignee: Stierlen-Maquet Aktiengesellschaft, Rastatt, Fed. Rep. of Germany

[21] Appl. No.: 764,086

[22] Filed: Jan. 31, 1977

[30] Foreign Application Priority Data

Jan. 29, 1976 [DE] Fed. Rep. of Germany ..... 2603303

[51] Int. Cl.[2] ..... B66F 9/08; E04H 6/06

[52] U.S. Cl. ..... 414/609; 414/592

[58] Field of Search ..... 214/95 R, 89, 16.4 R, 214/622–625, 628, 16.1 R, 16.1 CC, 16.1 CE, 16 R; 212/18; 414/564, 592, 785, 609, 285, 610–611

[56] References Cited

U.S. PATENT DOCUMENTS

| | | | |
|---|---|---|---|
| 3,655,069 | 4/1972 | Gertsen | 214/622 X |
| 3,743,116 | 7/1973 | Giessler et al. | 214/95 R |
| 3,851,778 | 12/1974 | Schurch | 214/622 |

FOREIGN PATENT DOCUMENTS

| | | | |
|---|---|---|---|
| 2415760 | 10/1974 | Fed. Rep. of Germany | 214/95 R |

*Primary Examiner*—Stephen G. Kunin
*Assistant Examiner*—R. B. Johnson
*Attorney, Agent, or Firm*—Becker & Becker Inc.

[57] ABSTRACT

A loading and unloading station for conveyors with trolley driving systems which includes an automatic feeding and withdrawing device from and to a deposit place for transferring a container. The feeding and withdrawing device includes a grab movable into a shaft above the level of a container in the shaft.

7 Claims, 4 Drawing Figures

LOADING AND UNLOADING STATION FOR CONVEYORS WITH SUSPENDED TROLLEY DRIVING SYSTEMS

The present invention relates to a loading and unloading station for conveyors with suspended trolley drive systems which comprises automatic loading and unloading devices.

With automatic conveyors with suspended drive systems, the goods to be transported in containers are automatically moved into suspension means of the drive systems and are automatically withdrawn therefrom.

An arrangement has become known according to which the loading and unloading device which is equipped with a lifting unit is arranged below the floor, and the containers for transporting the respective goods are for unloading purposes lifted off the trolley drive system, are moved out of the pit, and by means of driving rollers are deposited on the floor. Such device is disclosed e.g. in German Offenlegungsschrift 22 59 369.

This known device has the drawback that in order to be able to lift the respective containers for the goods to be transported from below, the unloading device must be arranged below the floor, and that when constructing the building, mounting pits have to be provided which frequently cause static problems. A further drawback of this known device consists in that the moving-in into the transporting pit and the moving-out therefrom have to be effected at low speed in view of the goods to be transported, for instance, liquid-filled bowls. This requires considerable loading and unloading time.

It is, therefore, an object of the present invention to provide a loading and unloading station for conveyors with suspended drive systems which will overcome the above mentioned drawbacks, will permit the installation of the device on a plane already prepared floor, and will reduce the time for unloading the containers.

These and other objects and advantages of the invention will appear more clearly from the following specification in connection with the accompanying drawings, in which.

The device according to the present invention is characterized primarily by a grab which is adapted above the level of the containerfor the goods to be transported to move into the shaft. More specifically, the grab is fork-shaped for cooperation with the inner flanges provided on the top of the containers which flanges form part of I-shaped rails. For reducing the loading and unloading time, the path of the inward and outward movement of a container includes sine curve-shaped acceleration and retardation sections so that the main section of the path of movement can be passed through at an increased speed.

Figure 1:
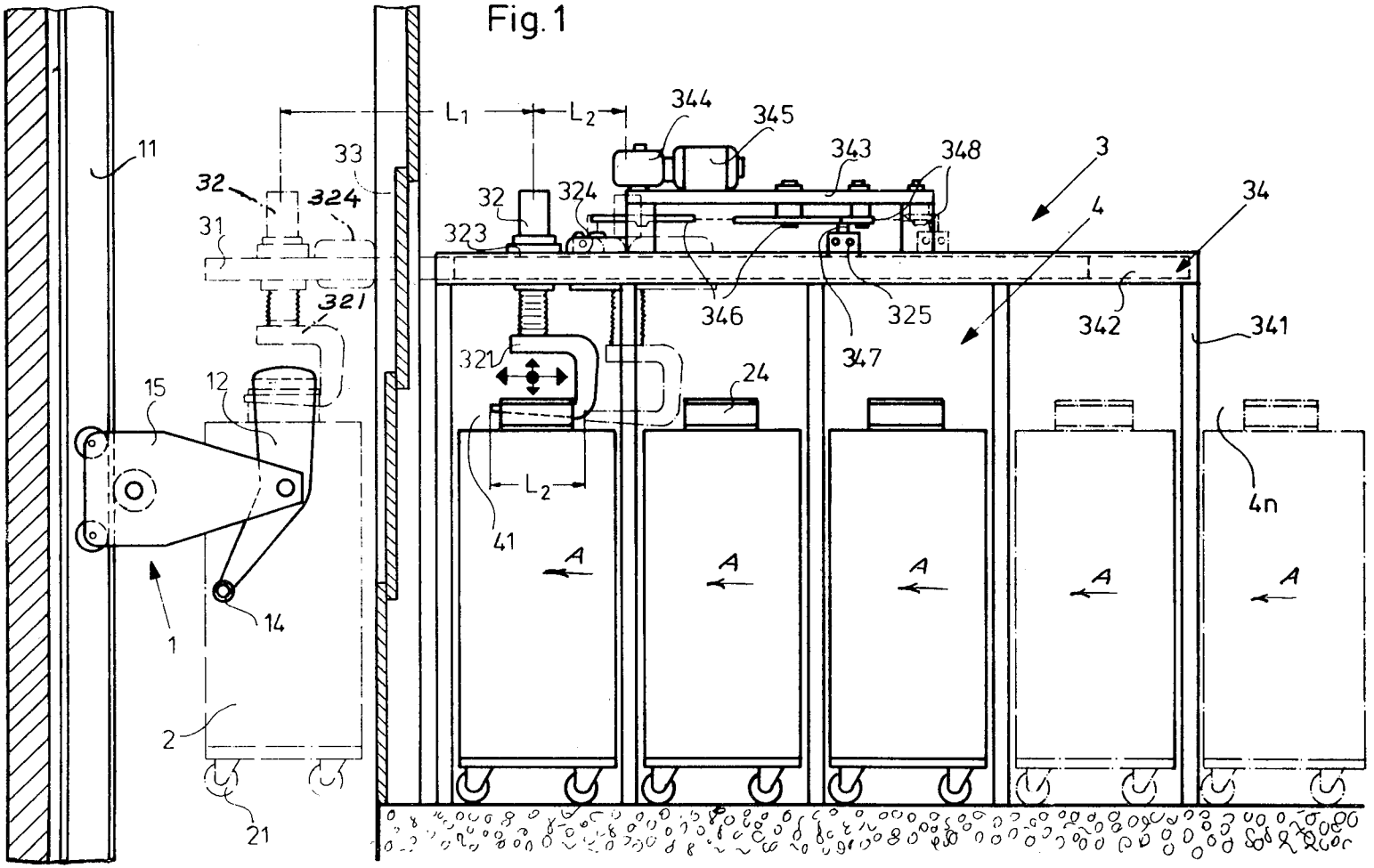
FIG. 1 is a diagrammatic illustration of a loading and unloading station according to the invention with a vertical driving rail.

Referring now to the drawings in detail, the program-controlled driven mechanisms 1 which move on the rails 11 can move on a horizontal level as indicated by arrows A as well as on a vertical track or rails 11 while the container 2 for the goods to be transported remains in its suspended position because it is in a pendulum-like manner connected to the arms 15 of the drive mechanism by means of the suspension 12. On the loading and unloading stations, the containers 2 for the goods to be transported which are provided with driving rollers 21 are in a space-saving manner arranged one adjacent the other and by a non-illustrated device are moved on by a distance which equals the width of a depositing place so that at the unloading station always the first depositing place 41 is kept free whereas at the loading station the first storage place is occupied. FIG. 1 shows a loading station at a vertical shaft. When the drive mechanism 1 stops at the loading station in response to the order "loading", automatically the station door 33 will open and the loading operation is effected in conformity with the following program.

Figure 2:
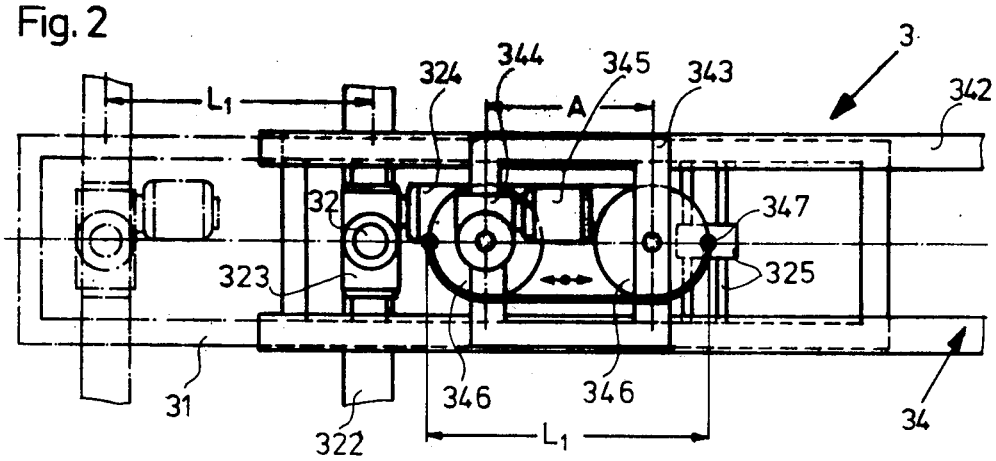
FIG. 2 is a top view of the loading and unloading device according to the invention.

The lifting device 32 driven by the lifting motor 324 through the lifting transmission 323 lifts the grab comprising the grab fork 321 and the grab boom 332 to such a height that the container 2 which is grasped at its rails 24 will be lifted off the floor. Thereupon the transporting motor 345 is automatically turned on responsive to the container 2 being lifted off the floor so that is transporting transmission 344 drives one of the two discs 346 either directly or indirectly. A chain passing around the sheaves 346 is provided with a follower 347; the follower 347 engages a coulisse slide of the coulisse 325 (one being shown best in FIG. 2 including four rods extending oppositely though operative the same way for FIG. 3 where more hidden from view) which is connected to the carriage 31. In this connection the carriage is displaced precisely about the length $L_1$ which corresponds to the distance of the central portion of the container in the shaft to the central portion of the container at the first depositing place 41. The shaft may also be called "transfer station".

Figure 3:
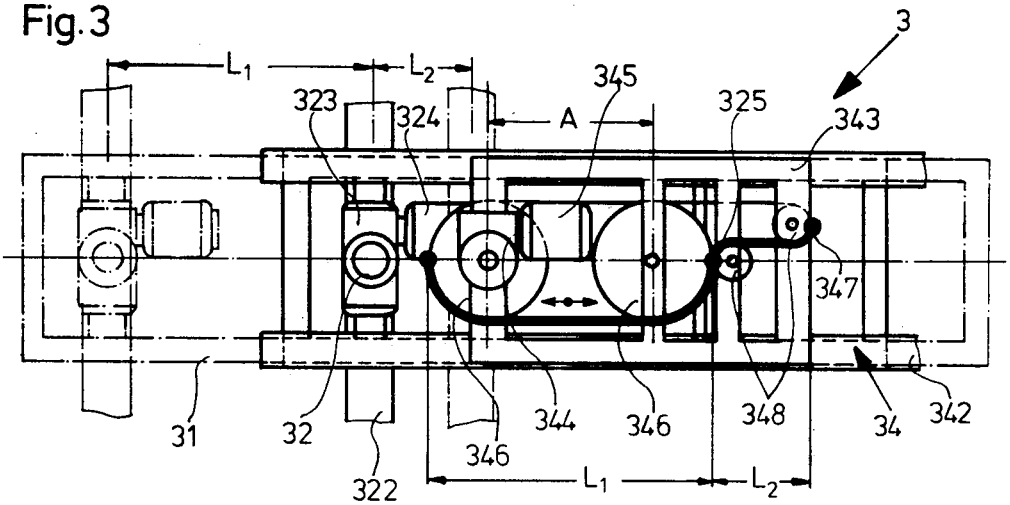
FIG. 3 is a top view of a loading and unloading device similar to that of FIGS. 1 and 2 but with means for a spontaneous loading and unloading of the containers.
Figure 4:
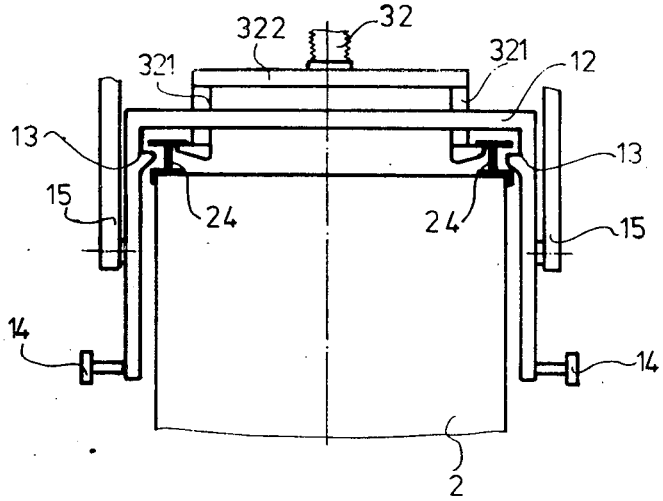
FIG. 4 is a diagrammatic front view of the suspension driving mechanism and of the grab during the transfer of a container for the goods to be transported from the loading device to the driving mechanism.

The design according to the present invention brings about that the carriage is in conformity with a sine curve accelerated over a distance which corresponds to the radius of the disc, is then over the distance A in FIG. 3 as compared with directional movement represented by arrows A in FIG.1 which corresponds to the space between the axles of the discs driven at full speed, and is then again slowed down in conformity with a sine curve over a distance which corresponds to the radius of the disc until the carriage comes to a standstill. This arrangement will assure a very precise positioning and a smooth transport as a result of which a spilling over of the liquid in the containers will be avoided.

If care is taken to the effect that the drive mechanism 1 stops so precisely that during the inward movement of the container 2 the supporting nose 13 of the suspension 12 will pass into the space between the upper and lower flange of the rail 24, it will be appreciated that by lowering the grab 321, 322, the drive mechanism 1 will take over the container 2. To this end, after completed inward movement of the carriage 31 into the transporting shaft, the lifting motor 324 is actuated and by means of the lifting device 32 lowers the grab 312, 322 to such an extent that after the container has been taken over by the supporting noses 13 of the suspension 12, the grab becomes free from the upper flange of the rail 24.

Now the transporting motor 345 is actuated and in the above described manner pulls the carriage 31 by the distance $L_1$ (FIGS. 1, 2 and 3) back to its starting position. When this starting position is reached, the station door 33 closes and the transporting mechanism 1 leaves the station with the container 2 suspended therein.

At the same time when the carriage 31 moves into the transporting path, the containers 2 are from their successive resting places, for instance by means of an advancing device, for instance of the type described in German Offenlegungsschrift 2 259 369, moved by the width of the resting place in the direction toward the station door 33 so that the returing grab 321, 322 will be able to grab the container which has arrived at the resting place 41. The entire loading device 3 is supported by supports 341 which at the same time may be used to define the compartments for the individual containers 2. The supports 341 support the carriage transport part 34 which comprises the supports for the guiding rails 342 and for the frame 343 from the transporting device. Connected to the frame 343 directly or indirectly are the transport transmission 344, the transport motor 345, and the disc 346.

A spontaneous removal is provided for at the first resting place 41 in order in urgent cases during the loading operation not to have to wait until the last container 2 arrives at 41 from its resting place 4n.

Accordingly, the return stroke of the transport carriage 31 is extended by a chain loop which is formed by the deflecting rollers 348 so that the follower will be able from its normal end position to move further on by the distance $L_2$ which is somewhat greater than the engaging length of the grab 321, 322. This movement is effected again by a precisely defined distance with a sine-shaped starting acceleration and a sine-shaped retardation up to a complete standstill whereby an abrupt starting and stopping will be avoided. Due to this greater return stroke of the grab, the container 2 standing in the first resting place 41 is freed by the grab so that the container 2 can be pulled out of its compartment by being suitably moved by an advancing device (not shown) and can be replaced by another container with more urgent goods to be transported. After the last mentioned container 2 has been moved into the first compartment, the grab 321, 322 after pressing a knob and a corresponding actuation of a switch is moved to its normal grabbing position where it grabs the newly inserted container 2. The loading operation can now be effected in the above described manner.

If the loading of the first compartment is to be effected not in the direction of the arrows A in FIG. 1, but is to be effected in the opposite direction, which means in the direction from the transporting carriage 1 to the first compartment 41, the operation is as follows. The transporting carriage 1 loaded with a container 2 stops in front of the station door 33 which opens automatically. Thereupon the carriage 31 moves out into the transporting path or compartment. By means of the lifting device 32 and the grab 321, 322 connected thereto the container 2 is slightly lifted in the manner described above so that the container 2 will be lifted off the supporting noses 13 of the suspension 12, whereupon the container 2 is by means of the carriage 31 pulled out or moved out of shaft T into the first compartment 41. The station door 33 is then closed and the transporting mechanism 1 can move on. The container 2 in the first compartment 41 is by means of the lifting device 32 placed with its wheels 22 onto the floor. The above described advancing device (not shown) will then move the container 2 in compartment 41 together with the other containers by the distance of one compartment to the right with regard to FIG. 1 so that the first compartment 41 will again be empty. When all compartments 41 to **4*n* are filled, the already mentioned transport loop with the deflecting rollers 348 will see to it that also a direct withdrawal of the container which arrived last in compartment 41** will be possible.

It is, of course, to be understood that the present invention is, by no means, limited to the specific showing in the drawings but also comprises any modifications within the scope of the appended claims.

It is claimed:

1. A loading and unloading station for a conveyor with a trolley driving system which includes a plurality of deposit stations for respectively receiving containers, a transfer station having gate means operable to establish communication between said transfer station and said deposit stations, carriage means movable in said transfer station and adapted to receive and carry a container, and a grab movable from one of said deposit stations to said transfer station and vice versa, said grab additionally being movable vertically for selectively picking up a container at said transfer station and releasing it at said one deposit station and also for picking up a container at said deposit station and releasing it at said transfer station onto said carriage, horizontally displaceable means operatively connected to said grab for moving the latter from a deposit station next to said transfer station to said transfer station and vice versa, a chain drive operatively connected to said horizontally displaceable means for displacing the latter, rail means for guiding said grab along a horizontal path from said transfer station to the nearest deposit station and vice versa, and in which said chain drive includes: two rotatable sprocket wheels stationarily journalled and arranged in spaced relationship to each other, a chain looped around said sprocked wheels, a coulisse connected to said horizontally displaceable means, and a follower connected to said chain and movable in a direction transverse to said horizontal path of said grab, said coulisse being connected to said horizontally displaceable means.

2. A loading and unloading station according to claim 1, in which said grab comprises a beam with a hook-shaped member at each end thereof for respective engagement with flanges of two rails connected to a container to be transported.

3. A loading and unloading station according to claim 1, which includes means associated with said grab for moving the latter vertically and horizontally.

4. A loading and unloading station according to claim 1, which includes horizontally displaceable means operatively connected to said grab for moving the latter from a deposit station next to said transfer station to said transfer station and vice versa, and which further includes a chain drive operatively connected to said horizontally displaceable means for displacing the latter.

5. A loading the unloading station according to claim 1, in which said horizontally displaceable means is a slide guided in said rail means.

6. A loading and unloading station according to claim 1, in which the total of the distance between the axes of rotation of said sprocket wheels and the radii of said sprocket wheels corresponds to the transfer stroke for a container from a deposit station to said transfer station and vice versa.

7. A loading and unloading station according to claim 1, in which said chain drive includes deflecting rollers increasing the length extension of said chain drive by distance sufficient to permit movement of said grab from the deposit station nearest to said transfer station in the direction toward the next following deposit station to such an extent as to allow removal of a container from said deposit station nearest to said transfer station while by-passing said grab and said transfer station.

* * * * *